US006160513A

United States Patent [19]

Davidson et al.

[11] Patent Number: 6,160,513

[45] Date of Patent: Dec. 12, 2000

[54] ANTENNA

[75] Inventors: Brian James Davidson, Woking Surrey; Joseph Christopher Modro, Owslebury Hampshire, both of United Kingdom

[73] Assignee: Nokiá Mobile Phones Limited, Espoo, Finland

[21] Appl. No.: 09/217,211

[22] Filed: Dec. 21, 1998

[30] Foreign Application Priority Data

Dec. 22, 1997 [GB] United Kingdom ..... 9727075

[51] Int. Cl.[7] ..... H01Q 1/38

[52] U.S. Cl. ..... 343/700 MS; 343/770

[58] Field of Search ..... 343/700 MS, 767, 343/770, 702

[56] References Cited

U.S. PATENT DOCUMENTS

| | | | |
|---|---|---|---|
| 4,067,016 | 1/1978 | Kaloi | 343/700 MS |
| 4,771,291 | 9/1988 | Lo et al. | 343/700 MS |
| 4,998,078 | 3/1991 | Hulkko | 333/109 |
| 5,276,920 | 1/1994 | Kuisma | 455/101 |
| 5,341,149 | 8/1994 | Valimaa et al. | 343/895 |
| 5,561,439 | 10/1996 | Moilanen | 343/846 |
| 5,581,266 | 12/1996 | Peng et al. | 343/770 |
| 5,627,550 | 5/1997 | Sanad | 343/700 MS |
| 5,644,319 | 7/1997 | Chen et al. | 343/702 |
| 5,657,028 | 8/1997 | Sanad | 343/700 MS |
| 5,680,144 | 10/1997 | Sanad | 343/700 MS |
| 5,832,372 | 11/1998 | Clelland et al. | 455/115 |
| 5,854,970 | 12/1998 | Kivela | 455/90 |
| 5,856,806 | 1/1999 | Koleda | 343/702 |

FOREIGN PATENT DOCUMENTS

| | | |
|---|---|---|
| 0 637 094 A1 | 2/1995 | European Pat. Off. . |
| 0 777 295 A2 | 6/1997 | European Pat. Off. . |
| 0 892 459 A1 | 1/1999 | European Pat. Off. . |
| WO 96/27219 | 9/1996 | WIPO . |
| WO 98/44588 | 10/1998 | WIPO . |

OTHER PUBLICATIONS

"Dual–Band Antenna For Hand Held Portable Telephones", Liu et al., Electronics Letters, vol. 32, No. 7, Mar. 28, 1996, pp. 609–610.

Patent Abstracts of Japan JP 10 209744.

PCT International Search Report.

United Kingdom Search Report.

*Primary Examiner*—Hoanganh Le

*Assistant Examiner*—James Clinger

*Attorney, Agent, or Firm*—Perman & Green, LLP

[57] ABSTRACT

An antenna is formed from a metal sheet partitioned by a slot. A corner of the metal sheet is short-circuited, and a field is coupled to the antenna near to the short circuit corner. The slot extends from a point near the field, across the metal sheet to an opposite corner to the short circuit corner. The metal sheet may be supported over air, or by a solid dielectric substrate.

15 Claims, 5 Drawing Sheets

ANTENNA

BACKGROUND OF THE INVENTION

The present invention relates to flat plate antennas.

Flat plate or low profile antennas such as planar inverted-F antennas (PIFA) are well known in the art. An example of a PIFA having an edge feed is shown in FIG. 1 of the accompanying drawings. The PIFA 100 comprises a flat conductive sheet 102 supported a height $L_1$ above a reference voltage plane 104 such as a ground plane. The sheet 102 may be separated from ground plane 104 by an air dielectric, or supported by a solid dielectric. A corner 106 of the flat sheet 102 is coupled to ground via stub 108. A feed section 110 is coupled to an edge of the flat sheet 102 adjacent grounded corner 106 at feed point 112. Feed section 110 may comprise the inner conductor of a coaxial feed line having a dielectric inner 114, and an outer conductor which is coupled to the ground plane 104. The PIFA 100 forms a resonant circuit having capacitance and inductance per unit area. Feed point 112 is positioned on sheet 102 a distance $L_2$ from corner 106 such that the impedance of the antenna 100 at that point matches the output impedance of the feed section, which is typically 50 ohms. The main mode of resonance for PIFA 100 is between the short circuit 106, and open circuit edge 116. Thus, the resonant frequency supported by PIFA 100 is dependent on the length of the sides of sheet 102, and to a lesser extent the distance $L_1$ and thickness of sheet 102.

Planar inverted-F antennas have found particular applications in the radio telephone art where their high gain and omni-directional radiation patterns are particularly suitable. They are also suitable for applications where good frequency selectivity is required. Additionally, since the antennas are relatively small at typical radio telephone frequencies they can be incorporated within the housing of a radio telephone, thereby not interfering with the overall aesthetic appeal of the radio telephone and giving it a more attractive appearance than radio telephones having external antennas. By placing the antenna inside the housing of a radio telephone, the antenna is less likely to be damaged and therefore have a longer useful life. The PIFA lends itself to planar fabrication, and may suitably be fabricated on the printed circuit board typically used in a radio telephone to support the electronic circuitry. This lends itself to cheap manufacture.

However, PIFA are relatively narrowband devices, typically 3.5% bandwidth about a nominal centre frequency. Thus, they are unsuitable for wide band or multi-band applications.

SUMMARY OF THE INVENTION

According to the present invention there is provided an antenna comprising a conductive polygonal lamina disposed opposing a reference voltage plane and galvanically coupled to the reference voltage plane adjacent a first vertex of the conductive lamina, and a feed point for the antenna disposed proximal to the first vertex of the lamina, wherein the conductive lamina is partitioned by a slot thereby forming first and second resonators.

An advantage of an embodiment in accordance with the invention is that smaller antennas may be fabricated for a given frequency range than hitherto possible. Additionally, relatively wide band operation may be achieved without multiple stacked elements, or having a large gap between the antenna plate and a ground plane.

In a preferred embodiment, the slot lies substantially on an axis of symmetry in the plane of the conductive lamina.

Preferably, the slot extends towards a second vertex confronting the first vertex.

Typically, the slot extends to the second vertex. Additionally, the feed point is disposed substantially colinear with and between the first and second vertices.

Suitably, the conductive lamina is in the form of a parallelogram, such as a square, and the slot extends in a diagonal direction of the square.

Advantageously, a periphery of the conductive lamina comprises at least one corrugation thereby forming an inductive stub. This loads the antenna and reduces the operational frequency for given physical dimensions of the antenna. Thus, a further reduction in antenna size may be achieved over a conventional plate antenna for a given operational frequency.

Typically, a short circuit slot extends from the first vertex towards the feed point a length in the range 0.01 $\lambda_{eff}$ to 0.03 $\lambda_{eff}$ where $\lambda_{eff}$ is the effective wavelength for a centre frequency of the antenna. Optionally, the width of the slot and/or the short circuit slot lies in the range 0.005 $\lambda_{eff}$ to 0.05 $\lambda_{eff}$ where $\lambda_{eff}$ is the effective wavelength for a centre frequency of the antenna.

BRIEF DESCRIPTION OF THE DRAWINGS

Embodiments of the invention will now be described by way of example only, and with reference to the accompanying drawings, in which.

DETAILED DESCRIPTION OF THE INVENTION

Figure 1:
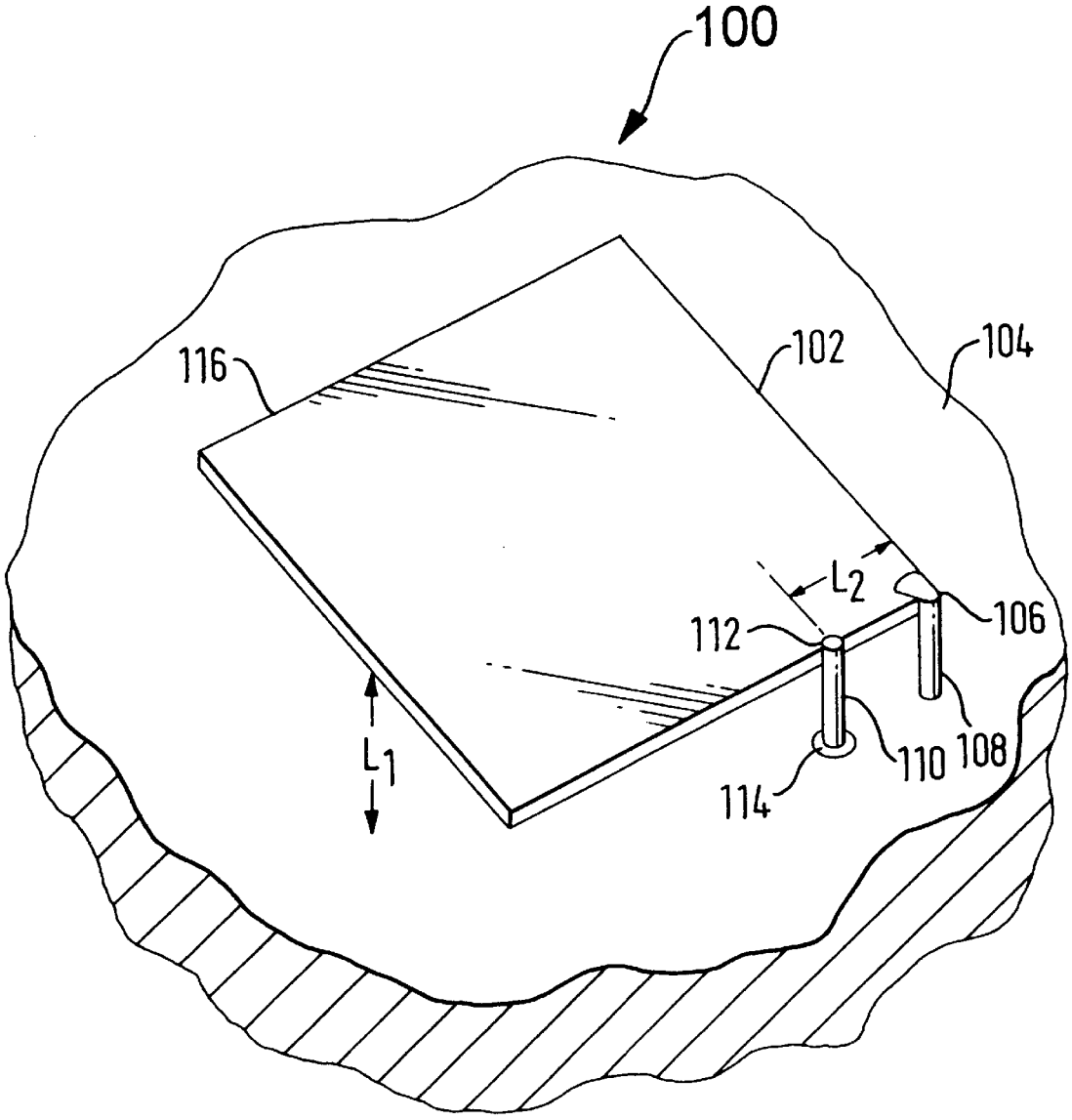
FIG. 1 (PRIOR ART)
FIG. 1 shows a conventional planar inverted-F antenna.

FIG. 1 shows a conventional planar inverted-F antenna 100 (PIFA). The antenna 100 is built on a conductive ground plane 104. The feed point is located at a point $L_2$ from one of the sides, and sheet 102 is supported $L_1$ above ground plane.

Figure 2:
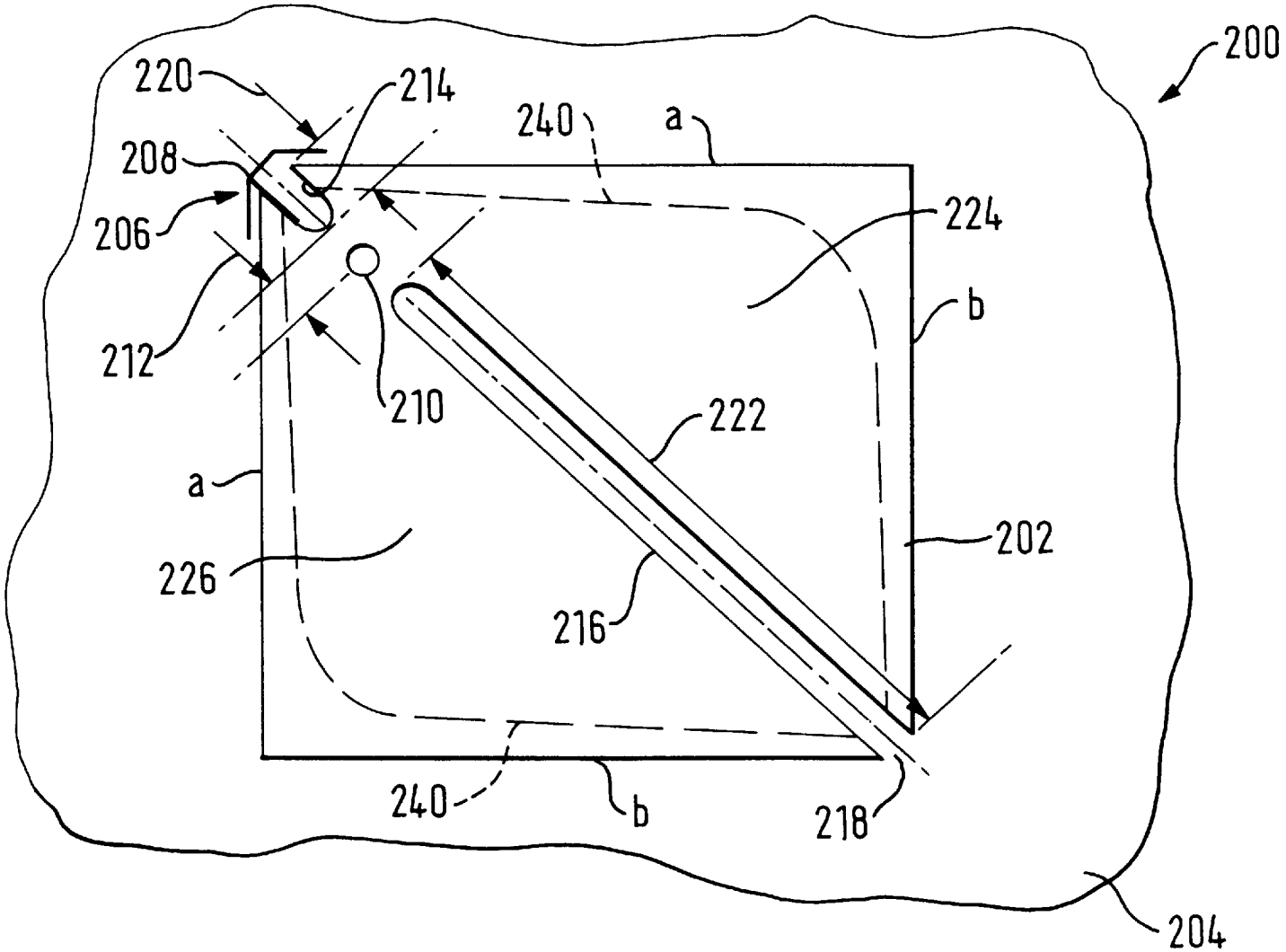
FIG. 2 shows a schematic representation of a first embodiment in accordance with the invention.

An embodiment in accordance with the invention is shown in FIG. 2. Antenna 200 comprises a square, flat metal sheet 202 disposed above a ground plane 204.

A corner 206 of the sheet 202 is connected to ground via a shorting stub 208. A feed point 210 is located along a diagonal at a distance 212 from the short circuited corner 206 to give a desired input/output impedance for antenna 200. A short tuning slot 214 extends from the short-circuited corner 206. The distance 212 and dimensions of slot 214 are configured to typically provide an impedance 50 ohms. An extended slot 216 extends from a corner 218, diagonally opposite the short circuited corner 206, towards the short-circuited corner 206 and stops a short distance from feed point 210.

The effective permitivity, $\epsilon_{eff}$, for the PIFA 200 shown in FIG. 2 may be calculated to a first order approximation by considering the antenna 200 to be a microstrip structure. Such a calculation is well documented in the relevant art, and would be straight forward for a person of ordinary skill in the art.

The operational mode of antenna 200 is such that a radio frequency current input at feed point 210 propagates across sheet 202 in two quarter-wave resonant modes. The modes are disposed about slot 216, and in the case of a square sheet 202 are substantially symmetric about slot 216. The radio frequency current, shown dotted line 240 in FIG. 2, flows along the periphery of antenna 200. Thus, the resonant length of antenna 200 for each mode is the sum of the two sides, a and b, along which the radio frequency current propagates. For a square, the sides are equal and a=b.

The centre frequency, $f_r$, of operation is given by $$f_r = \frac{c}{4(a+b)\epsilon_{eff}},$$

where c is the speed of light in vacuum and $\epsilon_{eff}$ is the effective permitivity of antenna 200. An alternative expression is that $\lambda_r$=4(a+b), where $\lambda_r$ is the resonant wavelength. Using the foregoing relationships, an antenna in accordance with the present invention may be configured for a desired centre frequency of operation. Slots 214 and 216 act to promote the existence of the two modes of propagating, and their respective lengths 220, 222 are appropriately dimensioned. The short-circuit slot length 220 is made as long as possible consistent with promoting the peripheral resonant modes, and inhibiting a diagonal mode, i.e. a resonant mode between corners 206, 218. Suitably, the short-circuit slot length 220 lies in the range given by $0.01\ \lambda_{eff} \leqq 220 \leqq 0.03\ \lambda_{eff}$, where $\lambda_{eff}$ is the effective wavelength. Additionally, corner 206 is angled, e.g. substantially right-angled, to promote the peripheral resonant modes. Flat sheet 202 is spaced a distance above the ground plane 204. The spacing h typically satisfies the relationship, $0.02\ \lambda_{eff} \leqq h \leqq 0.10\ \lambda_{eff}$. The slot gap, g, for slots 214, 216 lies in the range, $0.005\ \lambda_{eff} \leqq g \leqq 0.05\ \lambda_{eff}$. The gap for respective slots 214, 216 need not be the same.

The operational bandwidth of antenna 200 is proportional to the coupling coefficient between respective resonators 224, 226 formed on either side of slot 216. The coupling between the resonators is proportional to h/g Turning now to FIG. 3, there follows a description of a preferred embodiment in accordance with the invention, operable for a centre frequency of 790 Mhz. Like parts to those in FIG. 2 will be referred to using like reference numerals.

Figure 3:
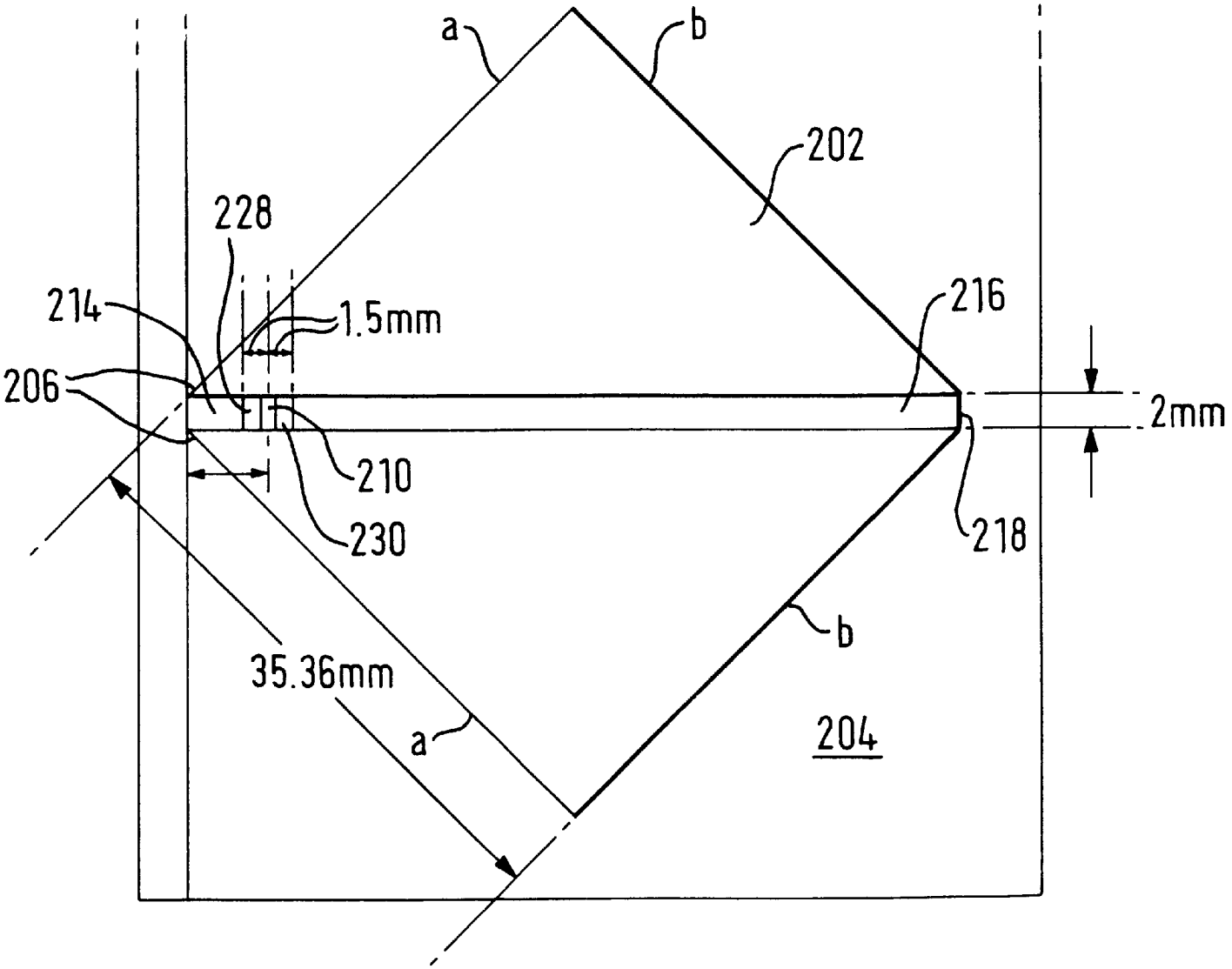
FIG. 3 shows a schematic representation of a second embodiment in accordance with the invention.

Metal sheet 202 is supported on a Poly Ether Imide (PEI) substrate 5 mm thick. The relative permitivity $\epsilon_r$ of PEI is 3.1 and the effective permitivity $\epsilon_{eff}$ of the structure shown in FIG. 3 is 2.1 to a first order approximation. On the other side of the substrate is a ground plane 204. Metal sheet 202 forms a polygon comprising two right-angled isosceles triangles separated along their hypoteneuse by a short-circuited slot 214, and longer slot 216. Slots 214 and 216 are 2 mm wide. The equal sides of the triangles (a,b) are 35.36 mm long. The centre of feed point 210 is located in a metallised area 228 between the two triangles and is 1.5 mm from the end of short circuit slot 214, which has a length 220 of 3.5 mm. Slot 216 begins after a 1.5 mm section of metallisation 230 from the feed point 210 and extends between the two triangles.

Figure 4:
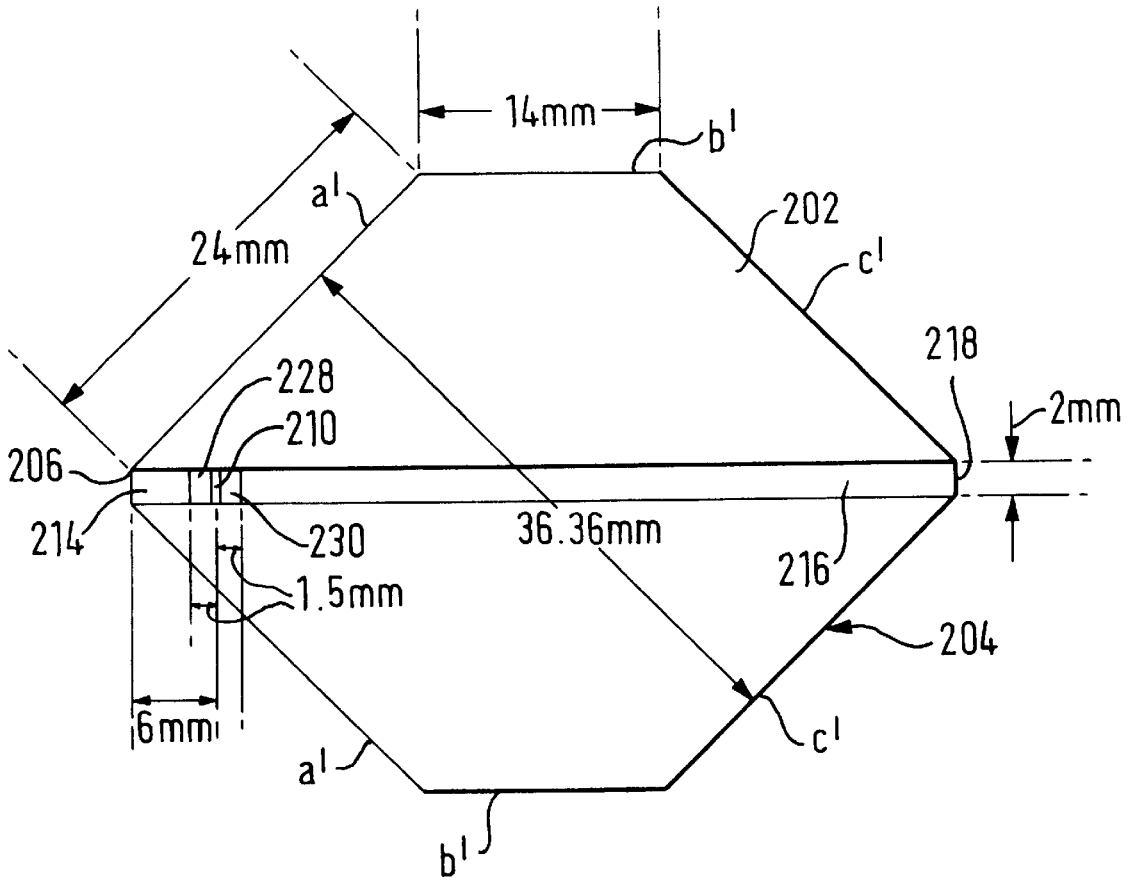
FIG. 4 shows a schematic representation of a third embodiment in accordance with the invention.

Another embodiment is now described with reference to FIG. 4. As before, like parts to those in FIG. 2 will be referred to using like numerals. The antenna shown in FIG. 4 is designed for a centre frequency of 825 Mhz. Metal plate 202 is supported on a PEI substrate having the same effective permitivity as described in relation to FIG. 3, 5 mm thick, and having a ground plane 204 on its other side. The antenna is a polygon formed from two truncated isosceles triangles of sides a', b', c'. Sides a' and c' are 24 mm long, and side b' is 14 mm long. The two parts are separated by slots 214, 216 having gap widths of 2 mm. Short circuited tuning slot 214 is 4.5 mm long, and the centre of feed point 210 is separated from the end of tuning slot 214 by a 1.5 mm long section 228 of metallisation 202. A further 1.5 mm metallised section 230 separates the feed point centre 210 from the beginning of slot 216. Side a' is parallel to side c', and is separated by 35.36 mm. Sides a' and c' form a 45° angle with the edge of slots 214 and 216 respectively.

Figure 6:
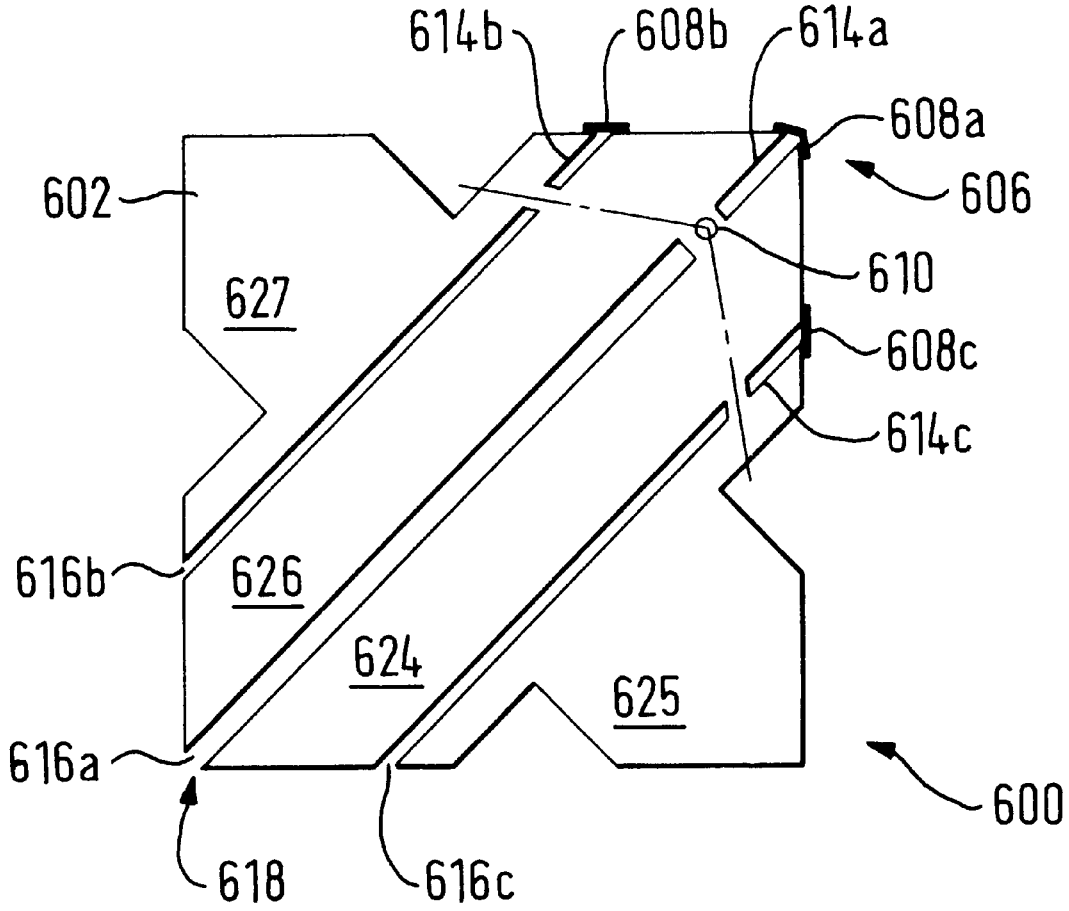
FIG. 6 shows a fifth embodiment of an antenna in accordance with the invention.

A fifth embodiment of an antenna in accordance with the invention is shown in FIG. 6. Antenna 600 comprises a flat metal sheet 602 disposed above a ground plane (not shown).

A corner 606 of the sheet 602 is connected to ground via a shorting stub 608*a*. A feed point 610 is located along a diagonal at a distance from the short circuited corner 606 to give a desired input/output impedance for antenna 600. A short tuning slot 614*a* extends from the short-circuited corner 606. The distance and dimensions of the tuning slot 614*a* are configured to typically provide an impedance of 50 ohms. An extended slot 616*a* extends from a corner 618, diagonally opposite the short-circuited corner 606, towards the short-circuited corner 606 and stops a short distance from feed point 610.

In addition the antenna comprises two further slots 616*b, c* either side of the central slot 616*a* and two further tuning slots 614*b, c* either side of the central tuning slot 614. Each of the tuning slots 608*b, c* are also connected to ground by shorting stubs 608*b, c*.

The feed point 610 provides a common feed to the four resonators 624, 625, 626 and 627 formed by the slots 616*a, b, c*. The length of the slots 616*b* and c is slightly shorter than the length of slot 616*a*. Therefore the resonators 625 and 627 will resonate at a slightly higher frequency than resonators 624 and 627.

Thus it is believed that such an antenna will have a broader bandwidth than that shown for example in FIG. 1.

Figure 5:
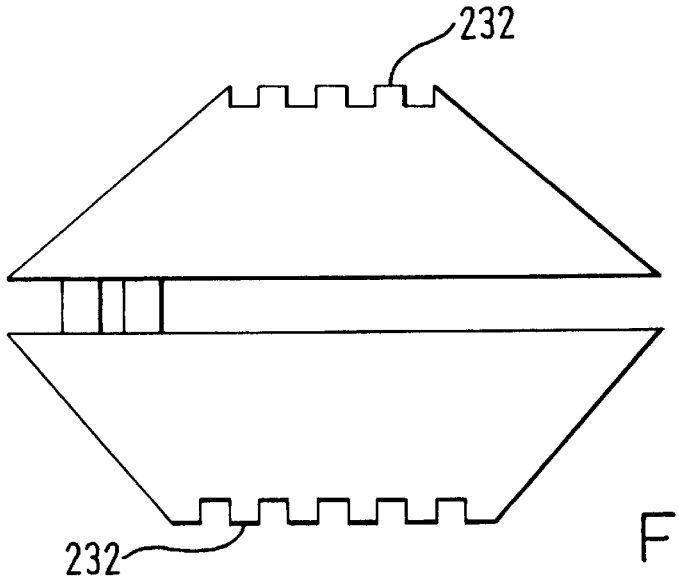
FIG. 5 shows a fourth embodiment of an antenna in accordance with the invention having corrugated sides.

In view of the foregoing description it will be evident to a person skilled in the art that various modifications may be made within the scope of the invention. For example, the angle at corners 206 and 208 need not be 90°, but only sufficient to promote peripheral modes, e.g. it may lie in a range 75 to 105 degrees. Additionally, the respective parts of the polygonal metallisation 202 need not be symmetric about slots 214, 216. Optionally, one or more sides of the polygon may be corrugated as shown 232 in FIG. 5, in order to inductively load the peripheral mode of resonance, thereby shortening the physical dimensions of the antenna for a given centre frequency. Additionally, slot 218 need not extend fully across the polygonal lamina metal sheet 202, but just by an amount suitable to maintain separation of the peripheral resonant modes, e.g. down to as short as 50% of the length between the confronting vertices.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during prosecution of this application or of any such further application derived therefrom.

What is claimed is:

1. An antenna comprising:

a conductive polygonal lamina disposed opposing a reference voltage plane and galvanically coupled to the reference voltage plane adjacent a first vertex of the conductive lamina; and a feed point for the antenna disposed proximal to the first vertex of the lamina;

wherein the conductive lamina is partitioned by a slot thereby forming first and second resonators.

2. An antenna according to claim 1, wherein the slot lies substantially on an axis of symmetry in the plane of the conductive lamina.

3. An antenna according to claim 1 wherein the slot extends towards a second vertex confronting the first vertex.

4. An antenna according to claim 3, wherein the slot extends to the second vertex.

5. An antenna according to claim 3, wherein the feed point is disposed substantially collinear with and between the first and second vertices.

6. An antenna according to claim 1 wherein a short circuit slot extends from the first vertex towards the feed point a length in the range 0.01 $\lambda_{eff}$ to 0.03 $\lambda_{eff}$ where $\lambda_{eff}$ is the effective wavelength for a centre frequency of the antenna.

7. An antenna according to claim 1, wherein the width of the slot lies in the range 0.005 $\lambda_{eff}$ to 0.05 $\lambda_{eff}$ where $\lambda_{eff}$ is the effective wavelength for a centre frequency of the antenna.

8. An antenna according to claim 1 wherein the conductive lamina is in the form of a parallelogram, and the first and second vertices define a diagonal direction of the parallelogram.

9. An antenna according to claim 1, wherein the conductive lamina is in the form of a square.

10. An antenna according to claim 1, wherein an edge of the lamina is corrugated.

11. A radio communication device including an antenna comprising:

a conductive polygonal lamina disposed opposing a reference voltage plane and galvanically coupled to the reference voltage plane adjacent a first vertex of the conductive lamina; and a feed point for the antenna disposed proximal to the first vertex of the lamina;

wherein the conductive lamina is partitioned by a slot thereby forming first and second resonators.

12. An antenna comprising:

a conductive polygonal lamina disposed opposing a reference voltage plane and galvanically coupled to the reference voltage plane adjacent a first vertex of the conductive lamina; and a feed point for the antenna disposed proximal to the first vertex of the lamina;

wherein the conductive lamina is partitioned by a first slot and a second slot forming first and second resonators in the conductive lamina, the first slot extending through the first vertex and stopping a first distance from the feed point, and the second slot extending through a second vertex diagonally opposed the first vertex and stopping at a second distance from the feed point.

13. The antenna of claim 12 wherein a length and a width of the first slot is configured to provide an impedance of 50 ohms.

14. An antenna comprising:

a flat metal sheet disposed above a ground plane, a first corner of the sheet being connected to the ground plane;

a feed point substantially located along a diagonal axis at a distance from the first corner to provide a required input/output impedance for the antenna;

wherein the metal sheet includes a first tuning slot and a first extended slot, the first tuning slot extending through the first corner towards the feed point, and the first extended slot extending through a second corner diagonally opposed the first corner towards the feed point;

the metal sheet further comprising a first resonator and a second resonator on a first side of the metal sheet formed by a second extended slot and a second tuning slot adjacent to the first extended slot and the first tuning slot respectively, and a third resonator and a fourth resonator on a second side of the metal sheet formed by a third extended slot and a third tuning slot adjacent to the first extended slot and the first tuning slot respectively.

15. The antenna of claim 14 wherein a length of the second extended slot and the third extended slot is shorter than a length of the first extended slot and wherein the first resonator in the first side of the sheet and the fourth resonator in the second side of the sheet will resonate at a frequency higher than the second and third resonators.

* * * * *